US010893698B2

(12) United States Patent
Guyard et al.

(10) Patent No.: US 10,893,698 B2
(45) Date of Patent: Jan. 19, 2021

(54) HYDROPHOBIC SMOKING ARTICLE TUBE

(71) Applicant: PHILIP MORRIS PRODUCTS S.A., Neuchatel (CH)

(72) Inventors: Aurelien Guyard, Pompaples (CH); Benoit Mivelaz, Sion (CH)

(73) Assignee: Philip Morris Products S.A., Neuchatel (CH)

( * ) Notice: Subject to any disclaimer, the term of this patent is extended or adjusted under 35 U.S.C. 154(b) by 209 days.

(21) Appl. No.: 15/577,423

(22) PCT Filed: Jun. 24, 2016

(86) PCT No.: PCT/IB2016/053793

§ 371 (c)(1),
(2) Date: Nov. 28, 2017

(87) PCT Pub. No.: WO2017/001989

PCT Pub. Date: Jan. 5, 2017

(65) Prior Publication Data

US 2018/0160724 A1 Jun. 14, 2018

Related U.S. Application Data

(60) Provisional application No. 62/187,504, filed on Jul. 1, 2015.

(51) Int. Cl.
*A24D 1/02* (2006.01)
*A24D 1/04* (2006.01)
(Continued)

(52) U.S. Cl.
CPC ..... *A24D 1/022* (2013.01); *A24D 1/02* (2013.01); *A24D 1/045* (2013.01); *A24D 3/048* (2013.01); *A24D 3/061* (2013.01); *A24D 3/067* (2013.01)

(58) Field of Classification Search
CPC ..... A24D 1/022; A24D 1/045; A24D 3/04; A24D 3/048; A24D 3/06; A24D 3/061;
(Continued)

(56) References Cited

U.S. PATENT DOCUMENTS

2013/0081644 A1* 4/2013 Noda ..... A24D 3/04 131/337
2013/0236647 A1 9/2013 Samain et al.
2014/0261469 A1* 9/2014 Kissling ..... A24C 5/06 131/70

FOREIGN PATENT DOCUMENTS

TW 201132301 A1 1/2011
TW 201132301 A * 10/2011
(Continued)

OTHER PUBLICATIONS

International Search Report and Written Opinion for PCT/IB2016/053793, issued by the European Patent Office as the search authority, dated Aug. 31, 2016, 9 pgs.
(Continued)

*Primary Examiner* — Joseph S Del Sole
*Assistant Examiner* — Jamel M Nelson
(74) *Attorney, Agent, or Firm* — Mueting Raasch Group

(57) ABSTRACT

A smoking article tube includes an elongated tube having a mouthpiece segment at a first end and an empty smokable material cavity defined by a second end of the elongated tube opposing the first end. A hydrophobic tube region includes hydrophobic groups covalently bonded to the elongated tube.

20 Claims, 1 Drawing Sheet

(51) Int. Cl.
*A24D 3/04* (2006.01)
*A24D 3/06* (2006.01)

(58) Field of Classification Search
CPC ..... A24D 3/062; A24D 3/065; A24D 3/067; A24D 1/02; A24F 13/00; A24F 13/02; A24F 13/14; A24F 13/16; A24F 15/00; A24F 15/02; A24F 15/04; A24F 15/12; A24F 15/14; A24F 15/20
See application file for complete search history.

(56) References Cited

FOREIGN PATENT DOCUMENTS

| | | | | | |
|---|---|---|---|---|---|
| TW | 201132301 | A | * | 10/2011 | |
| WO | WO 99/53778 | A2 | | 10/1999 | |
| WO | WO 2014/017709 | A1 | | 1/2014 | |
| WO | WO 2014/079949 | A1 | | 5/2014 | |
| WO | WO 2015/008253 | A1 | | 1/2015 | |
| WO | WO-2015008253 | A1 | * | 1/2015 | ..... A24D 1/02 |
| WO | WO 2016/063180 | A1 | | 4/2016 | |
| WO | WO 2016/063181 | A1 | | 4/2016 | |
| WO | WO 2016/063182 | A1 | | 4/2016 | |
| WO | WO 2016/108119 | A1 | | 7/2016 | |
| WO | WO 2016/142759 | A1 | | 9/2016 | |
| WO | WO 2014/086802 | A2 | | 6/2017 | |
| WO | WO 2017/137857 | A1 | | 8/2017 | |

OTHER PUBLICATIONS

International Preliminary Report on Patentability issued by the International Bureau of WIPO for PCT/IB2016/053793, dated Jan. 11, 2018; 6 pgs.

Taiwan Office Action for TW Application No. 105116560, issued by the Intellectual Property Office Ministry of Economic Affairs, dated Oct. 18, 2019; Received Oct. 21, 2019; 7 pgs.

* cited by examiner

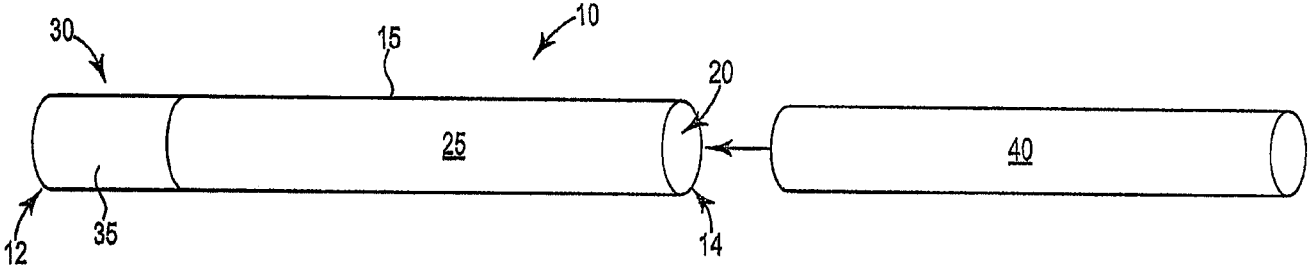
10
30
15
25
35
20
12
14
40

HYDROPHOBIC SMOKING ARTICLE TUBE

This application is the § 371 U.S. National Stage of International Application No. PCT/IB2016/053793, filed 24 Jun. 2016, which claims the benefit of U.S. Provisional Application No. 62/187,504, filed 1 Jul. 2015, the disclosures of which are incorporated by reference herein in their entireties.

The present disclosure relates to a hydrophobic smoking article tubes for use in making-your-own (MYO) smoking articles such as, cigarettes.

Combustible smoking articles, such as cigarettes, typically comprise a cylindrical rod of tobacco cut filler surrounded by a wrapper and typically a cylindrical filter axially aligned in an abutting end-to-end relationship with the wrapped tobacco rod. The cylindrical filter typically comprises a filtration material circumscribed by a plug wrap. The wrapped tobacco rod and the filter are joined by a band of tipping wrapper, normally formed of a paper material that circumscribes the entire length of the filter and an adjacent portion of the wrapped tobacco rod. A cigarette is employed by a consumer by lighting one end thereof and burning the shredded tobacco rod. The smoker then receives mainstream smoke into their mouth by drawing on the mouth end or filter end of the cigarette.

Alternatives to buying pre-manufactured cigarettes are to roll-your-own (RYO) or make-your-own (MYO) cigarettes. RYO uses tobacco rolling substrates, including "rolling paper," "cigarette paper," "cigar wraps," "wraps" and the like. Generally speaking, these substrates are small sheets, rolls, or leaves of paper substrate that are packaged and sold for rolling smokable product into a cigarette form. Typically, the rolling process is accomplished either by hand or with the aid of a rolling apparatus. Rolling paper is offered for those people who prefer to roll their own cigarette or cigar, where the person can customize the cigarette or cigar using any blend of smokable product rolled into any shape and size they prefer. During the process of rolling a cigarette, an individual sheet of rolling paper may be filled a smokable product. The cigarette is formed by wetting (typically by licking) the adhesive strip and overlaying it onto the rolling paper to form the cigarette.

MYO uses ready-made cigarette tubes, which can optionally include a filter at a first end or mouthend and an open second end. Loose tobacco can be used to fill the open second ends of the cigarette tubes. Alternatively a pre-portioned tube or casing of smokable material, which is not intended for smoking by itself, can be inserted into the ready-made cigarette tube. Once the tobacco or smokable material is loaded into the cigarette tube, the MYO cigarette or smoking article can be consumed.

MYO cigarette tubes are susceptible to wetting, and wetting the cigarette tubes can weaken the cigarette tubes and lead to wrinkling, tearing or staining of the cigarette tubes. Packages of cigarette tubes, where cigarette tubes are stacked together, have a tendency to stick together. This is especially true in hot and humid environments.

It would be desirable to provide MYO cigarette tubes that resist water or moisture absorption. It is also desirable to provide MYO cigarette tubes that did not stick to each other when stacked together in packaging. It would also be desirable that the MYO cigarette tubes not affect the taste of the smoke or aerosol generated by the MYO smoking article. It is also desirable to provide MYO cigarette tubes that retain moisture in the tobacco or smokable material that is placed within the MYO cigarette tube and protects the MYO product from drying out quickly.

According to a first aspect, an elongated smoking tube has a mouthpiece segment at a first end of the elongated tube and an empty smokable material cavity defined by a second end of the elongated tube opposing the first end. A hydrophobic tube region comprising hydrophobic groups covalently bonded to the elongated tube.

In another aspect, an hydrophobic tube region has a water contact angle of at least about 90 degrees or at least about 100 degrees and a Cobb measurement value (at 60 seconds) of about 40 $g/m^2$ or less, or about 35 $g/m^2$ or less.

In a further aspect, a hydrophobic tube region is produced by a process comprising the steps of: applying a liquid composition comprising a fatty acid halide to at least one surface of a hydrophobic tube region and maintaining the surface at a temperature of about 120° C. to about 180° C. The fatty acid halide reacts in situ with protogenic groups of material in the hydrophobic tube region resulting in the formation of fatty acid esters.

MYO cigarette tubes that include a hydrophobic tube region or substrate region can reduce wetting or absorption of water or moisture into the smoking article tube or cigarette tube from humidity or wet tobacco placed within the empty smokable material cavity of the MYO cigarette tubes, for example. As a result, the structural properties of the MYO cigarette tube are maintained. The hydrophobic tube region can also prevent adjacent MYO cigarette tubes from sticking to each other when stacked together in packaging. The hydrophobic tube region does not negatively affect the taste of the mainstream smoke or aerosol generated by the rolled smoking article and perceived by a consumer consumption of the rolled smoking article. In addition, the hydrophobic tube region can retain moisture in the tobacco or smokable material and slow down or reduce the rate of drying of the loaded tobacco or smokable material within the MYO cigarette tube. The hydrophobic tube region can also prevent or reduce wetting or staining of the mouthpiece segment when a filter flavour capsule is broken and releases flavour liquid within the filter element.

Smoking articles in accordance with the present disclosure may be cigarettes or other smoking articles in which tobacco material forming a tobacco substrate or tobacco rod is combusted to form mainstream smoke. MYO cigarette tubes includes a smokable material cavity for smokable material and optionally a filter element. Alternatively a pre-portioned tube or casing of smokable material, which is not intended for smoking by itself, can be inserted into the ready-made cigarette tube smokable material cavity.

The term "smoking article" is used here to indicate cigarettes, cigars, cigarillos and other articles in which a smokeable material, such as a tobacco, is lit and combusted to produce smoke.

The term "tobacco" shredded tobacco or tobacco cut filler, or it may include reconstituted tobacco or cast leaf tobacco, or a mixture of both.

The term "mainstream smoke" is used herein to indicate smoke produced by combustible smoking articles, such as cigarettes. Mainstream smoke flows through the smoking article and is consumed by the user.

The term "MYO cigarette tube" or "smoking article tube" refers to a ready-made cigarette or smoking article that is has a cylindrical shape defining a mouthpiece segment at a first end and an empty cavity at an opposing end. The empty cavity is configured to receive smokable material such as tobacco.

The term "hydrophobic" refers to a surface exhibiting water repelling properties. One useful way to determine this is to measure the water contact angle. The "water contact angle" is the angle, conventionally measured through the liquid, where a liquidvapour interface meets a solid surface. It quantifies the wettability of a solid surface by a liquid via the Young equation.

The term "mouthpiece" or "mouthpiece segment" is used herein to indicate the portion of the smoking article that is designed to be contacted with the mouth of the consumer. The mouthpiece can be the portion of the smoking article that can includes a filter, or in some cases the mouthpiece can be defined by the extent of the tipping paper, if present. In other cases, the mouthpiece can be defined as a portion of the smoking article extending about 40 mm from the mouth end of the smoking article, or extending about 30 mm from the mouth end of the smoking article.

The present disclosure provides a smoking article tube for forming a MYO smoking article. In one embodiment of the invention, the smoking article tube has a hydrophobic tube region. Hydrophobic groups are covalently bonded to protogenic groups, such as hydroxyl groups, on the cellulosic material forming the smoking article tube. The hydrophobic groups forming the hydrophobic tube region can be selectively deposited on only one of or both of the empty smokable material cavity or the mouthpiece segment.

It is contemplated that the hydrophobic smoking article tube can reduce and prevent water, moisture, or liquid adsorption into or transmittal through the hydrophobic tube region. The hydrophobic smoking article tube also does not negatively affect the taste of the mainstream smoke or aerosol generated by the smoking article and perceived by a consumer consuming the smoking article.

The hydrophobic smoking article tube can also inhibit the transfer, absorption and accumulation of humectant, water and staining that can occur when the hydrophobic smoking article tube is stored or utilized in a humid environment, particularly where the humidity is very high (e.g., relative humidity greater than 70%, 80%, 90%, 95%, 99%) or when the hydrophobic smoking article tube is stored for an extended period, (e.g., more than 24 hours, two days, one week, or one month), or a combination of such conditions. In addition, the hydrophobic smoking article tube can also inhibit the transfer, absorption and accumulation of humectant, water and staining that can occur high moisture tobacco or smokable material is loaded into the empty smokable material cavity of the hydrophobic smoking article tube.

The hydrophobic smoking article tube is an elongated tube that can be fabricated of a paper, homogenized paper, homogenized tobacco-impregnated paper, homogenized tobacco, wood pulp, hemp, flax, rice straw, esparto, eucalyptus and the like. The substrate or paper forming the elongated tube can have any suitable basis weight. The basis weight of the substrate or paper forming the elongated tube can be in a range from about 10 to about 50 grams per square meter or from about 15 to about 45 grams per square meter. The substrate or paper forming the elongated tube can have any suitable thickness. The thickness of the substrate or paper forming the elongated tube can be in a range from about 10 to about 100 micrometres or preferably from about 30 to about 70 micrometres.

The hydrophobic smoking article tube is sized to meet the common, standard smoking article dimensions. Hydrophobic smoking article tubes are dimensionally referenced by the longitudinal dimension (length) and diameter. The typical length of hydrophobic smoking article tube ranges from about 70 mm to about 110 mm with Standard Size lengths from about 70 mm to about 80 mm, and a King Size length ranges from about 100 mm to about 110 mm. The typical diameter of hydrophobic smoking article tube is from about 5 mm to about 12 mm.

The hydrophobic smoking article tube includes an elongated tube having a mouthpiece segment at a first end and an empty smokable material cavity defined by a second end of the elongated tube opposing the first end. In many embodiments, a hydrophobic tube region includes hydrophobic groups covalently bonded to the elongated tube defining the smokable material cavity and the mouthpiece segment. In some embodiments, a hydrophobic tube region includes hydrophobic groups covalently bonded only to the elongated tube defining the smokable material cavity. In other embodiments, a hydrophobic tube region includes hydrophobic groups covalently bonded only to the elongated tube defining the mouthpiece segment.

The mouthpiece of smoking articles in accordance with the present invention may comprise a filter including one or more filter segments of filtration material. For example, the mouthpiece may comprise a single segment of filtration material, or the mouthpiece may comprise a multi-segment filter including two or more segments of filtration material. Where two or more filter segments are provided, the filter segments may be of the same construction and materials as each other. Preferably, however, the filter segments have a different construction, and/or contain different filtration material to each other.

The filter can include a flavorant. The flavourant may impart a flavour to enhance the taste of mainstream smoke produced during consumption of the smoking article. A flavourant is any natural or artificial compound that affects the organoleptic quality of a mainstream smoke. Plants that can be used to provide flavourants, include but are not limited to, those belonging to the families, Lamiaceae (e.g., mints), Apiaceae (e.g., anise, fennel), Lauraceae (e.g., laurels, cinnamon, rosewood), Rutaceae (e.g., citrus fruits), Myrtaceae (e.g., anise myrtle), and Fabaceae (e.g., liquorice). Non-limiting examples of sources of flavourants include mints such as peppermint and spearmint, coffee, tea, cinnamon, clove, ginger, cocoa, vanilla, chocolate, eucalyptus, geranium, agave, and juniper.

Many flavourants are essential oils, or a mixture of one or more essential oils. An "essential oil" is an oil having the characteristic odour and flavour of the plant from which it is obtained. Suitable essential oils include, but are not limited to, eugenol, peppermint oil and spearmint oil. In many embodiments the flavourant comprises menthol, eugenol, or a combination of menthol and eugenol. In many embodiments, the flavourant further comprises anethole, linalool, or a combination of thereof. The term "herbaceous material" is used to denote material from an herbaceous plant. A "herbaceous plant" is an aromatic plant, the leaves or other parts of which are used for medicinal, culinary or aromatic purposes and are capable of releasing flavour into smoke produced by a smoking article. Herbaceous material includes herb leaf or other herbaceous material from herbaceous plants including, but not limited to, mints, such as peppermint and spearmint, lemon balm, basil, cinnamon, lemon basil, chive, coriander, lavender, sage, tea, thyme and caraway. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens* variegata. In some embodiments, a flavourant can include tobacco material.

The flavourant may be provided directly onto a component of a filter. Alternatively, the flavourant may be provided as part of a flavourant delivery component that is configured to release the flavourant in response to a trigger mechanism. In some embodiments, the flavourant is a particulate flavourant material. Suitable particulate flavourant materials include particles of a sorbent or cellulosic material impregnated with a liquid flavourant.

The term "liquid release component" is used herein to refer to a discrete piece or portion of a liquid delivery material which is in a form that is suitable to be incorporated into a smoking article. The liquid release component releases a liquid comprising a functional material. The liquid release component is preferably in the form of a bead, a capsule or a microcapsule. In preferred embodiments, the liquid release component is a flavourant delivery component for providing flavour in a smoking article. As used herein, the term "liquid" refers to compositions that are in a liquid state at room temperature, for example, 22° C.

In some embodiments, the flavourant is provided in a capsule which is adapted to release at least a portion of a liquid when the capsule is subjected to external force, such as squeezing, by the consumer. Thus, rupturing the capsule releases an amount of liquid flavourant into the filter segment or filtration material. The capsule can comprise an outer shell and an inner core containing the flavourant. Preferably, the outer shell is sealed before the application of an external force, but is frangible or breakable to allow the flavourant to be released when the external force is applied. The capsule may be formed in a variety of physical formations including, but not limited to, a single-part capsule, a multi-part capsule, a single-walled capsule, a multi-walled capsule, a large capsule, and a small capsule. Alternatively, the liquid flavourant is contained in a liquid releasing component which comprises a matrix structure defining a plurality of domains enclosing the liquid flavourant and which provides a sustained-release delivery profile, such that the amount of the flavour composition released upon compression of the flavour release component can be controlled through the adjustment of the compressive force applied by the consumer. Those of skill in the art will understand that the term "sustained release" covers those embodiments in which the amount of flavourant released at a given force depends additionally on the duration of the applied force.

In many embodiments, hydrophobic groups are covalently bonded to the inner surface of the elongated tube defining the mouthpiece segment or filter segment. In other embodiments, the hydrophobic groups are covalently bonded to the outer surface of the elongated tube defining the mouthpiece segment or filter segment. It has been found that covalently bonding hydrophobic groups to only one side or major surface of the elongated tube imparts hydrophobic properties to the opposing side or major surface of the elongated tube. The hydrophobic mouthpiece segment or filter segment can reduce or prevent liquid flavourant or liquid release component from staining or absorbing or transmitting through the elongated tube defining the mouthpiece segment or filter segment.

The empty smokable material cavity is defined by the second end of the elongated tube opposing the first end or mouthpiece segment. The empty smokable material cavity can have any useful longitudinal dimension (length). In many embodiments the empty smokable material cavity has a longitudinal dimension (length) in a range from about 40 mm to about 90 mm or from about 50 mm to about 80 mm. The diameter of the empty smokable material cavity is defined by the inner surface diameter of the elongated tube. In many embodiments the diameter of the empty smokable material cavity is from about 4 mm to about 10 mm or from about 6 mm to about 8 mm. Loose tobacco, a tobacco plug or a pre-portioned tube or casing of smokable material, which is not intended for smoking by itself, can be inserted into the empty smokable material cavity.

In many embodiments, hydrophobic groups are covalently bonded to the inner surface of the elongated tube defining the smokable material cavity. In other embodiments, the hydrophobic groups are covalently bonded to the outer surface of the elongated tube defining the smokable material cavity. It has been found that covalently bonding hydrophobic groups to only one side or major surface of the elongated tube imparts hydrophobic properties to the opposing side or major surface of the elongated tube. The hydrophobic smokable material cavity can reduce or prevent liquid components of the tobacco or smokable material from staining or absorbing or transmitting through the elongated tube defining the smokable material cavity.

In various embodiments, the elongated tube and particularly the elongated tube region defining the smokable material cavity or mouthpiece segment is hydrophobic or has one or more hydrophobic substrate regions. This hydrophobic tube region has a Cobb water absorption (ISO535:1991) value (at 60 seconds) of less than about 40 $g/m^2$, less than about 35 $g/m^2$, less than about 30 $g/m^2$, or less than about 25 $g/m^2$.

In various embodiments, the elongated tube and particularly the elongated tube region defining the smokable material cavity or mouthpiece segment or hydrophobic tube region has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. Hydrophobicity is determined by utilizing the TAPPI T558 om-97 test and the result is presented as an interfacial contact angle and reported in "degrees" and can range from near zero degrees to near 180 degrees. Where no contact angle is specified along with the term hydrophobic, the water contact angle is at least 90 degrees.

The hydrophobic surface can be uniformly present along the length of the elongated tube region defining the smokable material cavity or mouthpiece segment or hydrophobic tube region. In some configurations the hydrophobic surface is not uniformly present along the length of the elongated tube region defining the smokable material cavity or mouthpiece segment or hydrophobic tube region. In some embodiments the hydrophobic surface forms a pattern along all or only a portion of the length of the elongated tube region defining the smokable material cavity or mouthpiece segment or hydrophobic tube region.

The elongated tube region defining the smokable material cavity or mouthpiece segment or hydrophobic tube region can be formed of any suitable cellulose material, preferably cellulose material derived from plants, as described above. In many embodiments the elongated tube region defining the smokable material cavity or mouthpiece segment or hydrophobic tube region is formed of a material with pendent protogenic groups. The term "protogenic" refers to a group that is able to donate a hydrogen or a proton in a chemical reaction. Preferably, the protogenic groups are reactive hydrophilic groups such as but not limited to a hydroxyl group (—OH), an amine group ($NH_2$), or a sulfhydryl group (—$SH_2$).

The invention will now be described, by way of example, with reference to the elongated tube region defining the smokable material cavity or mouthpiece segment or hydrophobic tube region comprising hydroxyl groups. Material with pendent hydroxyl groups includes cellulosic material such as paper, wood, textile, natural as well as artificial fibers. The elongated tube region defining the smokable material cavity or mouthpiece segment or hydrophobic tube region can also include one or more filler materials, for example calcium carbonate, carboxy methylcellulose, potassium citrate, sodium citrate, sodium acetate or activated carbon.

The hydrophobic surface or region of the cellulosic material forming the hydrophobic tube region can be formed with any suitable hydrophobic reagent or hydrophobic group. The hydrophobic reagent is preferably chemically bonded to the cellulosic material or pendent protogenic groups of the cellulosic material forming the hydrophobic tube region. In many embodiments the hydrophobic reagent is covalently bonded to the cellulosic material or pendent protogenic groups of the cellulosic material. For example, the hydrophobic group is covalently bonded to pendent hydroxyl groups of cellulosic material forming the hydrophobic tube region. A covalent bond between structural components of the cellulosic material and the hydrophobic reagent can form hydrophobic groups that are more securely attached to the paper material than simply disposing a coating of hydrophobic material on the cellulosic material forming the hydrophobic tube region. By chemically bonding the hydrophobic reagent at the molecular level in situ rather than applying a layer of hydrophobic material in bulk to cover the surface allows the permeability of the paper to be better maintained, since a coating tends to cover or block pores in the cellulosic material forming the continuous sheet and reduce the permeability. Chemically bonding hydrophobic groups to the paper in situ can also reduce the amount of material required to render the surface of the hydrophobic tube region hydrophobic. The term "in situ" as used herein refers to the location of the chemical reaction which takes place on or near the surface of the solid material that forms the hydrophobic tube region, which is distinguishable from a reaction with cellulose dissolved in a solution. For example, the reaction takes place on or near the surface of cellulosic material forming the hydrophobic tube region which comprises cellulosic material in a heterogenous structure. However, the term "in situ" does not require that the chemical reaction takes place directly on cellulosic material forming the hydrophobic tube region.

The hydrophobic reagent may comprises an acyl group or fatty acid group. The acyl group or fatty acid group or mixture thereof can be saturated or unsaturated. A fatty acid group (such as a fatty acid halide) in the reagent can react with pendent protogenic groups such as hydroxyl groups of the cellulosic material to form an ester bond covalently bonding the fatty acid to the cellulosic material. In essence, these reactions with the pendant hydroxyl groups can esterify the cellulosic material.

In one embodiment of the invention, the acyl group or fatty acid group includes a $C_{12}$-$C_{30}$ alkyl (an alkyl group having from 12 to 30 carbon atoms), a $C_{14}$-$C_{24}$ alkyl (an alkyl group having from 14 to 24 carbon atoms) or preferably a $C_{16}$-$C_{20}$ alkyl (an alkyl group having from 16 to 20 carbon atoms). Those skill in the art would understand that the term "fatty acid" as used herein refers to long chain aliphatic, saturated or unsaturated fatty acid that comprises 12 to 30 carbon atoms, 14 to 24 carbon atoms, 16 to 20 carbon atoms or that has greater than 15, 16, 17, 18, 19, or 20 carbon atoms. In various embodiments, the hydrophobic reagent includes an acyl halide, a fatty acid halide, such as, a fatty acid chloride including palmitoyl chloride, stearoyl chloride or behenoyl chloride, a mixture thereof, for example. The in situ reaction between fatty acid chloride and cellulosic material forming the continuous sheet results in fatty acid esters of cellulose and hydrochloric acid.

Any suitable method can be utilized to chemically bond the hydrophobic reagent or group to the cellulosic material forming the hydrophobic tube region. The hydrophobic group is covalently bonded to the cellulosic material by diffusion of a fatty acid halide on its surface without using a solvent.

As one example, an amount of hydrophobic reagent, such as an acyl halide, a fatty acid halide, a fatty acid chloride, palmitoyl chloride, stearoyl chloride or behenoyl chloride, a mixture thereof, is deposited without solvent (solvent-free process) at the surface of the elongated tube paper at a controlled temperature, for example, droplets of the reagents forming 20-micrometer regularly-spaced circles on the surface. The control of the vapour tension of the reagent can promote the propagation of the reaction by diffusion with the formation of ester bonds between fatty acid and cellulose while continuously withdrawing unreacted acid chloride. The esterification of cellulose is in some cases based on the reaction of alcohol groups or pendent hydroxyl groups of cellulose with an acyl halide, such as an acyl chloride including a fatty acid chloride. The temperature that can be used to heat the hydrophobic reagent depends on the chemical nature of the reagent and for fatty acid halides, it ranges from about 120° C. to about 180° C.

The hydrophobic reagent can be applied to the cellulosic material of the elongated tube paper in any useful amount or basis weight. In many embodiments the basis weight of the hydrophobic reagent is less than about 3 grams per square meter, less than about 2 grams per square meter, or less than about 1 gram per square meter or in a range from about 0.1 to about 3 grams per square meter, from about 0.1 to about 2 grams per square meter, or from about 0.1 to about 1 gram per square meter. The hydrophobic reagent can be applied or printed on the elongated tube paper surface and define a uniform or non-uniform pattern.

Preferably the hydrophobic tube region is formed by reacting a fatty acid ester group or a fatty acid group with pendent hydroxyl groups on the cellulosic material of the elongated tube paper to form a hydrophobic surface. The reacting step can be accomplished by applying a fatty acid halide (such as chloride, for example) which provides the fatty acid ester group or a fatty acid group to chemically bond with pendent hydroxyl groups on the cellulosic material of the elongated tube paper to form a hydrophobic surface. The applying step can be carried out by loading the fatty acid halide in liquid form onto a solid support, such as a brush, a roller, or an absorbent or non-absorbent pad, and then contacting the solid support with a surface of the paper. The fatty acid halide can also be applied by printing techniques, such as gravure, flexography, ink jet, heliography, by spraying, by wetting, or by immersion in a liquid comprising the fatty acid halide. The applying step can deposit discrete islands of reagent forming a uniform or non-uniform pattern of hydrophobic areas on the surface of the elongated tube paper. The uniform or non-uniform pattern of hydrophobic areas on the elongated tube paper can be formed of at least about 100 discrete hydrophobic islands, at least about 500 discrete hydrophobic islands, at least about 1000 discrete hydrophobic islands, or at least about 5000 discrete hydrophobic islands. The discrete hydrophobic islands can have any useful shape such as a circle, rectangle or polygon. The discrete hydrophobic islands can have any useful average lateral dimension. In many embodiments the discrete hydrophobic islands have an average lateral dimension in a range from 5 to 100 micrometres, or in a range from 5 to 50 micrometres. To aid diffusion of the applied reagent on the surface, a gas stream can also be applied. Apparatus and processes such as those described in US patent publication 20130236647, incorporated herein by reference in its entirety, can be used to produce the hydrophobic tube region.

According to the invention, a hydrophobic tube region can be produced by a process comprising applying a liquid composition comprising an aliphatic acid halide (preferably a fatty acid halide) to at least one surface of elongated tube paper, optionally applying a gas stream to the surface to aid diffusion of the applied fatty acid halide, and maintaining the surface at a temperature about 120° C. to about 180° C., wherein the fatty acid halide reacts in situ with the hydroxyl groups of the cellulosic material in the elongated tube paper resulting in the formation of fatty acid esters. Preferably, the elongated tube paper is made of paper, and the fatty acid halide is stearoyl chloride, palmitoyl chloride, or a mixture of fatty acid chlorides with 16 to 20 carbon atoms in the acyl group. The hydrophobic elongated tube paper produced by a process described hereinabove is thus distinguishable from material made by coating the surface with a layer of pre-made fatty acid ester of cellulose.

The hydrophobic tube region is produced by a process of applying the liquid reagent composition to the at least one surface of an elongated tube paper at a rate of in a range from about 0.1 to about 3 grams per square meter, or from about 0.1 to about 2 grams per square meter, or from about 0.1 to about 1 gram per square meter. The liquid reagent applied at these rates renders the surface of the elongated tube paper hydrophobic.

In many embodiments, the thickness of the elongated tube paper allows the hydrophobic groups or reagent applied to one surface to spread onto the opposing surface effectively providing similar hydrophobic properties to both opposing surfaces. In one example, the thickness of the elongated tube paper was about 43 micrometres and both surfaces were rendered hydrophobic by the gravure (printing) process using stearoyl chloride as the hydrophobic reagent to one surface.

In some embodiments, the material or method to create the hydrophobic nature of the hydrophobic tube region does not substantially affect the permeability of the elongated tube defining the smokable material cavity. Preferably, the reagent or method to create the hydrophobic tube region changes the permeability of the elongated tube defining the smokable material cavity (as compared to the untreated elongated tube defining the smokable material cavity) by less than about 10% or less than about 5% or less than 1%.

In many embodiments the hydrophobic surface can be formed by printing reagent along a specified length of the elongated tube. Any useful printing methods can be utilized. The reagent can include any useful hydrophobic groups that can be reacted to chemically bond to the elongated tube defining the smokable material cavity pendent groups of the cellulosic material.

In many embodiments the hydrophobic surface can be formed by printing reagent along the length of the cellulosic material. Any useful printing methods can be utilized such as gravure, ink jet and the like. The reagent can include any useful hydrophobic groups that can be covalently bonded to the cellulosic material or pendent groups of the cellulosic material.

MYO smoking articles, such as cigarettes include a charge of tobacco received in the elongated tube defining the smokable material cavity. The charge of tobacco may comprise any suitable type or types of tobacco material or tobacco substitute, in any suitable form. Preferably, the tobacco includes flue-cured tobacco, Burley tobacco, Maryland tobacco, Oriental tobacco, specialty tobacco, homogenized or reconstituted tobacco, or any combination thereof. The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

FIG. 1 is a schematic perspective view of an illustrative smoking article tube with a charge of tobacco being inserted into the empty smokable cavity.

The smoking article tube is depicted in FIG. 1 and illustrate one or more embodiments of a smoking article tube or components of MYO smoking articles described above. The schematic drawing is not necessarily to scale and is presented for purposes of illustration and not limitation. The drawing depicts one or more aspects described in this disclosure. However, it will be understood that other aspects not depicted in the drawing fall within the scope and spirit of this disclosure.

Referring now to FIG. 1, an illustrative smoking article tube 10 with a charge of tobacco 40 being inserted into the empty smokable cavity 20, is depicted. The smoking article tube 10 has a generally cylindrical shape defined by an elongated tube 15 having a first end 12 and an opposing second end 14. A mouthpiece segment 30 is at the first end 12 and an empty smokable material cavity 20 is defined by a second end 14 of the elongated tube 15. A hydrophobic tube region 25 comprises hydrophobic groups covalently bonded to the elongated tube 15. The mouthpiece segment 30 can include a filter element 35.

The exemplary embodiments described above are not limiting. Other embodiments consistent with the exemplary embodiments described above will be apparent to those skilled in the art.

The invention claimed is:

1. A smoking article tube comprising:

an elongated tube having a mouthpiece segment at a first end of the elongated tube and an empty smokable material cavity defined by a second end of the elongated tube opposing the first end; and a hydrophobic tube region comprising hydrophobic groups covalently bonded to the elongated tube.

2. The smoking article tube according to claim 1, wherein the hydrophobic tube region only defines the smokable material cavity.

3. The smoking article tube according to claim 1, wherein the mouthpiece segment comprises a filter element and the hydrophobic tube region defines only the mouthpiece segment.

4. The smoking article tube according to claim 1, wherein the hydrophobic groups are covalently bonded to an inner surface of the elongated tube.

5. The smoking article tube according to any claim 1, wherein the hydrophobic groups are covalently bonded to an outer surface of the elongated tube.

6. The smoking article tube according to claim 1, wherein the hydrophobic tube region has a water contact angle of at least about 90 degrees.

7. The smoking article tube according to claim 1, wherein the hydrophobic tube region exhibits a Cobb measurement value (at 60 seconds) of about 40 $g/m^2$ or less.

8. The smoking article tube according to claim 1, wherein the hydrophobic tube region has a basis weight in a range from about 10 to about 50 $g/m^2$, and the hydrophobic group has a basis weight in a range from about 0.1 to about 5 $g/m^2$.

9. The smoking article tube according to claim 1, wherein the hydrophobic tube region comprises cellulosic material and the hydrophobic group is covalently bonded to cellulosic material by reacting in-situ a fatty acid halide with the cellulosic material.

10. The smoking article tube according to claim 9, wherein the fatty acid halide is palmitoyl chloride, stearoyl chloride, behenoyl chloride, or a mixture of palmitoyl chloride and stearoyl chloride.

11. The smoking article tube according to claim 1, wherein the hydrophobic tube region comprises fatty acid esters of cellulose.

12. The smoking article tube according to claim 1, wherein the hydrophobic group is covalently bonded to the hydrophobic tube region by chromatogeny.

13. The smoking article tube according to claim 1, wherein the hydrophobic tube region is produced by a process comprising the steps of: applying a liquid composition comprising a fatty acid halide to at least one surface of the hydrophobic tube region, maintaining the surface at a temperature of about 120° C. to about 180° C., wherein the fatty acid halide reacts in situ with protogenic groups of material in the hydrophobic tube region resulting in the formation of fatty acid esters.

14. The smoking article tube according to claim 13, wherein the process comprises applying a liquid composition comprising stearoyl chloride or palmitoyl chloride to at least one surface of the hydrophobic tube region at a temperature of about 120° C. to about 180° C., wherein hydroxyl groups in cellulosic material of the hydrophobic tube region reacts in-situ with the stearoyl chloride or palmitoyl chloride.

15. The smoking article tube according to claim 13, wherein the process comprises applying the liquid composition to a surface region of the hydrophobic tube region at a rate of in a range from about 0.1 to about 3 grams per square meter to render the surface region hydrophobic.

16. A container containing a plurality of smoking article tubes according to claim 1.

17. The smoking article tube according to claim 1, wherein the mouthpiece segment comprises a filter element, and the filter element comprises a flavorant.

18. The smoking article tube according to claim 17, wherein the flavorant comprises a liquid flavorant.

19. The smoking article tube according to claim 1, wherein the elongated tube does not contain tobacco.

20. The smoking article tube according to claim 1, wherein the empty smokable material cavity is configured to receive tobacco, or a pre-portioned tube of tobacco.

* * * * *